US008147301B2

(12) United States Patent
Ghattas

(10) Patent No.: US 8,147,301 B2
(45) Date of Patent: Apr. 3, 2012

(54) AIR HANDLING SYSTEM FOR CLEAN ROOM

(76) Inventor: Ray Ghattas, Woodland Hills, CA (US)

( * ) Notice: Subject to any disclaimer, the term of this patent is extended or adjusted under 35 U.S.C. 154(b) by 0 days.

(21) Appl. No.: 11/655,345

(22) Filed: Jan. 19, 2007

(65) Prior Publication Data

US 2007/0167126 A1 Jul. 19, 2007

Related U.S. Application Data

(60) Provisional application No. 60/766,441, filed on Jan. 19, 2006.

(51) Int. Cl.
*F24F 11/00* (2006.01)

(52) U.S. Cl. ..... 454/187

(58) Field of Classification Search ..... 454/187
See application file for complete search history.

(56) References Cited

U.S. PATENT DOCUMENTS 4,549,472 A * 10/1985 Endo et al. ..... 454/187
5,058,491 A * 10/1991 Wiemer et al. ..... 454/187
5,084,671 A * 1/1992 Miyata et al. ..... 324/760
5,314,516 A * 5/1994 Kashima ..... 55/484
5,565,034 A * 10/1996 Nanbu et al. ..... 118/668
5,664,995 A * 9/1997 O'Keefe ..... 454/58
5,876,280 A * 3/1999 Kitano et al. ..... 454/187
5,912,184 A * 6/1999 Young ..... 438/692
6,132,309 A * 10/2000 Panelli et al. ..... 454/187
6,230,080 B1 * 5/2001 Lee et al. ..... 700/275
6,318,113 B1 * 11/2001 Levy et al. ..... 62/426
6,372,042 B1 * 4/2002 Sung et al. ..... 118/52
6,572,468 B1 * 6/2003 Sasaki et al. ..... 454/187
6,755,734 B2 * 6/2004 Yokoyama et al. ..... 454/187
6,848,267 B2 * 2/2005 Pierson ..... 62/299
2004/0185769 A1 * 9/2004 Sung et al. ..... 454/187
2005/0048896 A1 * 3/2005 Shaben ..... 454/49
2005/0211415 A1 * 9/2005 Arts et al. ..... 165/59

* cited by examiner

*Primary Examiner* — Steven B McAllister
*Assistant Examiner* — Samantha Miller
(74) *Attorney, Agent, or Firm* — Christie, Parker & Hale, LLP

(57) ABSTRACT

A clean room air handling system is disclosed. The system includes an air handler adapted to receive an air flow, the air handler further provided with a cooling apparatus, and at least one supply fan for generating the air flow without a cooling apparatus directly associated therewith, and modulation means for operating said system.

18 Claims, 2 Drawing Sheets

AIR HANDLING SYSTEM FOR CLEAN ROOM

CROSS-REFERENCE TO RELATED APPLICATIONS

This application claims the benefit of the filing date of the following U.S. provisional patent application: No. 60/766,441, filed Jan. 19, 2006.

STATEMENT RE: FEDERALLY SPONSORED RESEARCH/DEVELOPMENT not applicable

BACKGROUND OF THE INVENTION

1. Field of the Invention

The present invention relates generally to air delivery systems in clean rooms and, more particularly, to an air handling system for use in clean rooms applications where large volumes of particulate free, temperature and humidity controlled airflow are required.

2. Description of the Related Art

Many enterprises, such as scientific laboratories, microelectronic manufacturers, testing labs, hospitals, and the like, require relatively clean air from which substantially all dust particles, micro-organisms, and pathogens have been removed. Further, the advent of high technology developments in aerospace, electronics, optics, telecommunications, robotics, medicine, and genetic engineering, among others known and those not yet contemplated, give rise to an ever growing need for "clean space" in manufacturing and research and development. The cleanest class of room according to federal standards is the Class 1 clean room. By way of comparison, Class 10,000 indicates that there are 10,000 or less particles of a size 0.5 micron and larger in one cubic foot of air and Class 1 indicates that there are 100 or less particles of a size 0.5 micron and larger in one cubic foot of air. Further, the contamination level of clean air is generally proportional to the number of air changes per hour that is caused to move through the space. When the clean room industry was established in the early 1960's, uniform mass air flow of HEPA (High Efficiency Particulate Absolute) filtered air was informally called "laminar flow" because of the uniform velocity or non-turbulent (laminar) flow of air either vertically or horizontally across the work space. As is well established, a typical clean room includes walls, floor, and ceiling, an air supply feeding a duct or plenum, a fan, and a filtration system generally comprising a plurality of panels hung below the ceiling securing a series of HEPA filters for filtering the air flow.

More particularly, the contamination level of clean space is generally proportional to the number of filtered air changes per hour that is caused to move through the space, which may also be correlated with energy usage. The air exchange rate generally varies from a low of about 20 air changes per hour to a high of about 200 to 300 (or more) air changes per hour depending on the application. The higher the air exchange rate the cleaner the room, and the larger the quantity of in-line components required, each of which introduces its own sources of inefficiencies. The present invention is intended to directed address and reduce the prior art energy inefficiencies.

As noted above, clean room air delivery systems are generally designed to filter out dirt and dust particles of a very small size, correct the humidity and temperature of the air, and supply that air into the clean room in a generally laminar airflow pattern. The laminar airflow may be either vertically downward from the ceiling to the floor, horizontally from one side of the clean room space to the other, or horizontally across the clean room work surface, and then downward to the floor. The vertically downward airflow direction is the most common in the industry. The volume of air delivery to the clean room ranges from approximately 30 cubic feet per minute to 120 cubic feet (or more) per minute per square foot of clean room floor space. This volume compares to 1.0 to 1.5 cubic feet per minute per square foot of floor space in a typical office building. Such clean room air delivery systems are often used in critical clean rooms such as certain aerospace and semiconductor manufacturing clean rooms, but have numerous applications where a particulate-free, temperature and humidity controlled environment is required.

The rising cost of energy related to clean room operations has reached critical cost levels. An important aspect of increased costs is the seemingly never-ending increase in energy costs necessary to operate at desired filtration standards in a cost-effective manner. Increased filtration requirements generally require higher air flow rates in combination with efficient use of HEPA filters for cost efficient use of the resulting clean space. However, turbulent distribution of air requires a greater number of air changes to achieve a given level of efficiency, wasting energy with resulting increases in energy usage and costs. Further, the costs of operating certain clean room elements, such as cooling coils, also directly and negatively impacts operational costs. Specifically, it is known that the related art commonly provides for the installation of a cooling coil in tandem with each supply fan, and operation of each such cooling coil necessarily adds to the heat load to be cooled, as well as including substantial costs related to unit costs for cooling coils and related hardware associated with each supply fan/cooling coil combination. Further, in such combination, an output airflow from each supply fan/cooling coil combination is now measurably hotter than the input airflow due to the heat output related to each additional cooling coil, which in turn must be compensated for by upsizing the entire system, also further negatively effecting operating efficiencies. Upsizing requirements include a significantly increased fan size. By way of example, it is known that cooling coils are designed with a restriction in air velocity therethrough which generally cannot be designed in excess of 500 feet/minute, in turn requiring a significant increase in the size of the fan and the fan box to support an increased cooling air flow, thereby further introducing additional size, weight, cost, and installation considerations and impediments.

Accordingly, it is clear there is a need for an improved clean room system design that lowers energy costs, decreases construction time lines, easily adapts to changing manufacturing space requirements, and can be readily constructed within current guidelines. The clean room system based upon such a design should be easily incorporated with respect to areas of any size, clean room expansion, filter requirements, and the like, "dirty" air return locations, lighting locations and fire sprinkler layout. The system should afford the ability to utilize automatic material handling systems (AMHS) and other production equipment from the ceiling grid without having to penetrate or otherwise modify any air barriers. The system should also not negatively affect the time required to achieve the critical air balance requirements.

The foregoing and other objectives of the invention will become apparent in light of the drawings, specification and claims contained herein. It should be noted and understood that with respect to the embodiments of the present invention disclosed herein, the materials and apparatus disclosed and suggested may be modified or substituted to achieve the desired protected structures without departing from the scope and spirit of the disclosed and claimed invention.

DETAILED DESCRIPTION OF THE PREFERRED EMBODIMENTS

Figure 1:
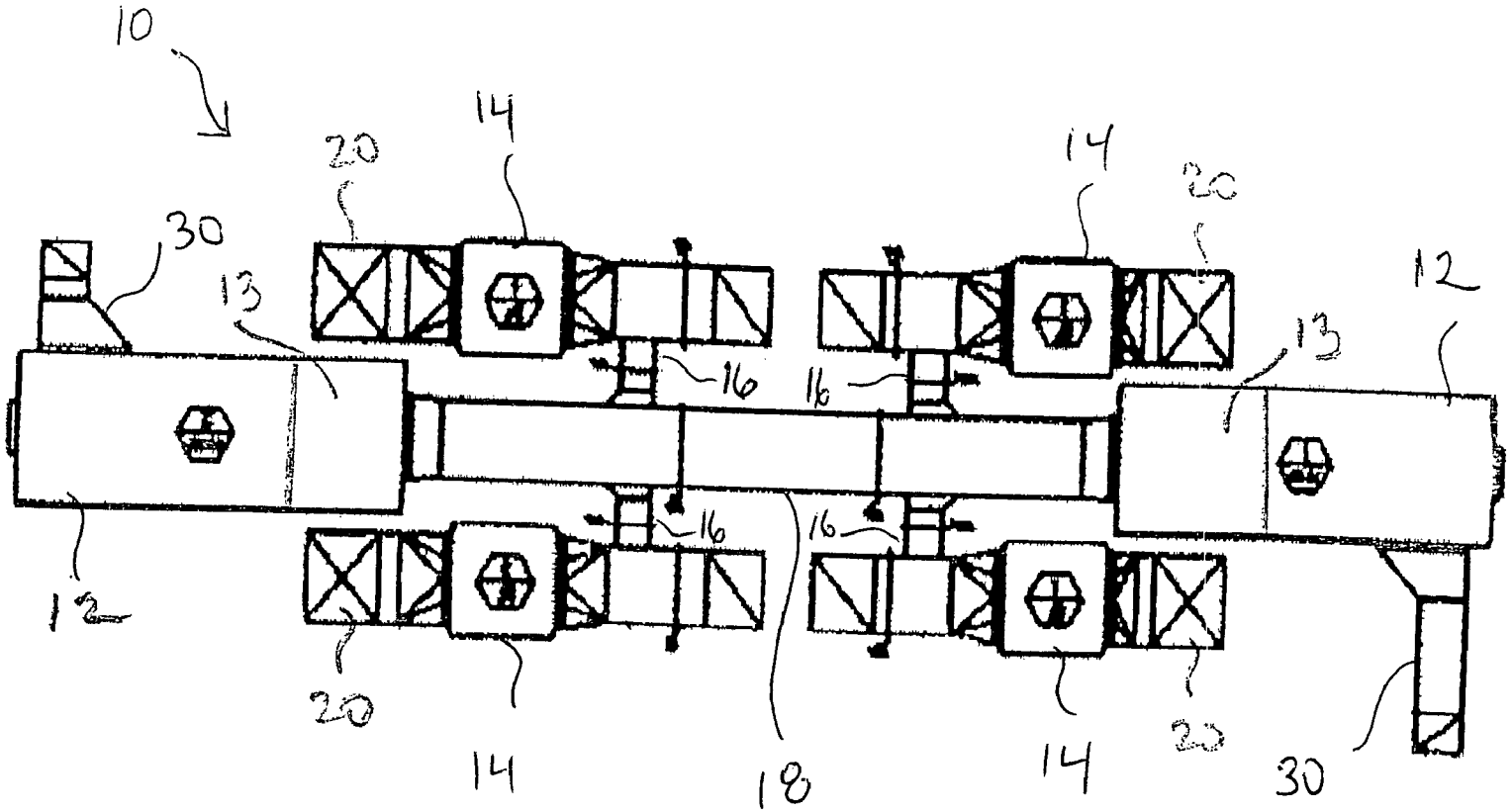
FIG. 1 illustrates schematically a clean room construction using the arrangement of the clean room of the present invention.

Referring to the drawings, the present invention is shown schematically in FIG. 1. In general, the inventive air handling system 10 for a clean room uses two air handling units 12 for handling an air flow. Each air handling unit 12 includes a makeup air handling unit (MAU) having a cooling unit 13 for providing desired conditioned air, including meeting specified parameters such as heating, airflow, and humidity characteristics, including temperature and relative humidity. A heating unit may be provided in connection with the MAU to also meet these requirements. As will be appreciated, return, relief, and exhaust systems provide the network that moves the air delivered by the supply distribution system back to the air handling units 12. The air is then re-circulated or exhausted out of the building as required for ventilation purposes, building pressure control purposes, or to control contamination from processes as is desired in the clean room environment.

In the present application, the return and relief paths associated with the air handling system 10 share the same network of duct and plenum space as is well established in the art. The return and relief paths are differentiated at the air handling unit location where the return path connects to the mixing chamber of the air handling unit and the relief path exits the building. Ideally, the pressure drop through the return-relief network should be the same in the return cycle and any relief cycle. Each air handling system has a relatively short path from the occupied space to the air handling unit, such that supply fans pressurize the space slightly, thereby providing the necessary force to move the air back through the return system or relief system. In the case of the present invention, the inventive system utilizes two (2) AHU's. Each AHU provides about 50% of the required heating load, which in turn provides a 50% cooling redundancy. In contrast, the prior art required air handling systems having supply fans, each of which incorporated a refrigeration unit such as a cooling coil therewith. According to the present invention, it has been discovered that equivalent air circulation may be efficiently and economically provided by air supply fans alone, without cooling coils provided in tandem therewith, and that cooling function is provided by a cooling coil or equivalent located adjacent the AHU. Specifically, it has been discovered that any of the related art refrigeration units, which may include chilled water, cooling coil, or other cooling configurations, may be positioned in tandem with the makeup hair unit only, according to the present invention, and the related art supply fan/cooling coil combination replaced only with air circulation fans which operate with significant cost efficiencies when compared with cooling configuration operating, maintenance, and installation costs.

As shown in the figures, system 10 includes for each AHU 12 which includes a cooling coil 13 is linked with at least one and preferably two supply fans 14 joined by ducts 16, 18 to output duct 20, and when both AHU's are operating in tandem, provides an overall 75% operational redundancy, compared with the related art. It will be appreciated that a greater or lesser number of supply fans 14 may be provided depending on operational and climatological limitations and requirements. It will be further appreciated that each supply fan 14 is of a high efficiency, low heat output design, thereby reducing further the heat load on the overall operating system. Cooling unit 13 such as a chilled water cooling coil with copper fin/copper tube construction is provided in tandem with each AHU 12, and completely replaces the use of any cooling coils previously provided in connection with supply fans of the prior art. Accordingly, supply fans 14, unlike the prior art, do not have a cooling coil directly associated therewith, thereby overcoming substantial inefficiencies of the prior art as previously discussed. According to the invention, each supply fan 14 may now operate at velocities up to or even greater than 1600 feet per minute due to the elimination of the ganged arrangement of the cooling coil of the prior art, such increased speed more than 300% faster compared with the 500 feet per minute limitation of the prior art. In turn, fan box dimensions may be substantially reduced, and no matter what size fan is selected, air velocity is not restricted in the manner of the prior art.

Additional efficiencies of this inventive arrangement due to the elimination of the cooling coil adjacent the supply fan include reduced heat load downstream of the mixing box/cooling coil located within the AHU, in turn resulting in a lower heat load downstream of the supply fan 14, thereby providing a lower temperature and relative humidity in the clean room in comparison with prior art supply fan/cooling coil arrangements for the same air flow, temperature, humidity inputs. The invention thus effectively replaces a makeup air handler having an external cooling coil, with a supply fan 14, eliminating the necessity of the prior art cooling coil, with reduced hardware costs and related installation costs as well as reduced on-going operational costs. Yet another important benefit is provision of the required number of air exchanges at significantly reduced cost.

As discussed above, exhaust systems are also required in most buildings to ensure that the outdoor air ventilation rates are maintained, control moisture accumulation, and remove contaminates. These systems may replace or supplement clean room systems essentially covering the totality of the building. Building mechanical codes and industry standards such as *ASHRAE Standard* 62-2001—*Ventilation for Acceptable Indoor Air Quality* typically set required flow rates. In most commercial buildings, a make-up air system must replace the air that is removed from the building in order to prevent building pressurization problems due to the exhaust flow. Make-up air functions are often combined with other air handling requirements in the air handling systems that supply air based on the building loads. Bringing the make-up air in with the main air handling systems often reduces the energy requirements associated with the make-up air due to energy recovery effects from return air. Further, exhaust systems need to be interlocked with their make-up air systems to ensure that both systems function together to prevent abnormal and potentially dangerous pressure relationships from developing. On large systems, such as may be found in large aerospace-related clean room-based buildings, this situation could easily occur if one system were started without the other system starting. Large systems may also require a specialized start-up sequence that ensures that both systems come up to speed at the same time. Further, variable flow supply systems often require variable flow exhaust systems to maintain the desired pressure relationships.

Accordingly, the present invention thus further utilizes the following operational scheme. A building automation system is commonly utilized to automate various building-based systems, including the operational controls of the clean room. For each operational phase, such as a daily operational schedule, one or more of the supply fans 14 for each air handling unit 12 is powered/depowered as required. Because supply fan output is critical to the success of the inventive system, airflow provided by each supply fan 14 is further controlled by a modulator, via a variable frequency drive or equivalent. Supply fan airflow is initially measured at the intake of the supply fan 14, and further inputs for measuring outputs and efficiency may be provided. To further modulate and monitor supply fan performance, current sensing switches and differential pressure switches positioned in series may be provided. The inventive air-handling system thus further uses variable frequency drive technology or equivalent to conserve energy. This feature varies the speed of the fans depending on thermal demand. Conversion from constant volume to variable air volume distribution (VAV) is known to provide a substantial reduction in fan energy requirements, as fan energy usage is generally the third largest energy user in commercial buildings, behind lighting and cooling, and according to the present invention, the remaining cooling load has essentially been eliminated to provide a remarkably efficient clean room air handling system. Also, chilled water and hot water valves are modulated under control of the system controller to maintain various set points, including delivered air temperature. With regard to system humidity control, return air humidity exceeding a preselected set point triggers modulation of the associated chilled water valve. Steam valve modulation is performed to maintain the return air humidity set point, and when exceeded, the steam isolation valve is modulated to a closed position.

In order to maintain proper pressure relationships, the make-up air must be introduced into the building in a manner that allows it to provide ventilation and reach the exhaust system via a reasonably unrestricted path. Outside and return air dampers are likewise modulated to maintain the room static pressure set point as a function of ambient (outdoor) conditions.

Accordingly, such outputs are then fed into the automation system to fine-tune operation of the clean room within required parameters. It will be further appreciated that the automation system may be utilized to maximize desired efficiency and performance as required or determined, as will be appreciated by the skilled artisan.

Figure 2:
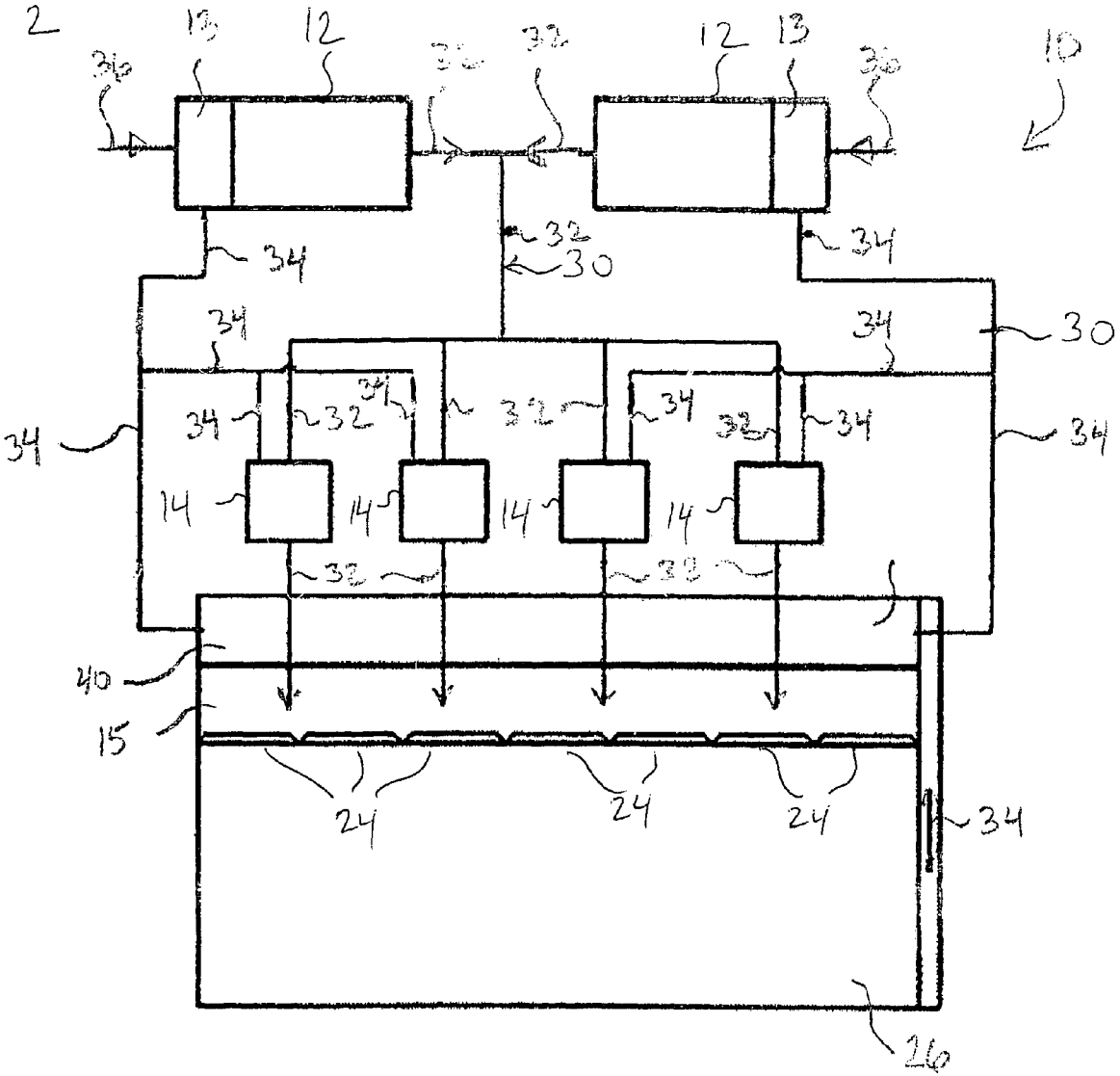
FIG. 2 illustrates schematically an airflow using the arrangement of the clean room of the present invention shown in FIG. 1.

FIG. 2 shows an exemplary flow chart of system 10, including air handler units 12. The MAU interfaces with a clean room plenum 15 for outputting a controlled air flow through HEPA filters 24 into controlled environment clean room 26, such as the above-described HEPA filters. It will be appreciated that the schematic shown is exemplary, and may be adapted for connection to provided a desired output via air unit duct work 30. This airflow is shown by airflow arrows 32 indicating a supply airflow. As such, air flows in the direction of arrows 36 into air handling unit 12 and then through supply air conduits represented by arrows 32, to and through supply fans 14, to be supplied to clean room plenum 15 and through filters 24 into clean room 26. Return air flow is via return air flow plenum 40, and then by airflow arrows 34. Outside airflow is shown by airflow arrows 36, for supplying an outside airflow into MAU.

Lastly, the inventive system 10 may be utilized for smoke purge, which is achieved by closing the return air dampers, and activating an air handler supply fan 14 in conjunction with a recirculation supply fan operated a speed sufficient to provide a reverse flow.

Although the invention has been described with reference to particular embodiments, the description is only an example of the invention's application and should not be taken as a limitation. In particular, even though much of the preceding discussion was aimed at semiconductor clean room systems, alternative embodiments of this invention are possible. Various other adaptations and combinations of features of the embodiments disclosed are within the scope of the invention as defined by the following claims.

What I claim is:

1. An air handling system for a clean room, comprising:

at least one air handler having a fan adapted to provide an air flow through an outlet of the at least one-air handler;

a cooling unit adjacent and in fluid communication with the at least one air handler;

at least one supply fan downstream of the at least one air handler, each supply fan disposed within a fan box having an inlet and an outlet, the inlet of each fan box communicating with the outlet of the at least one air handler through a first ductwork, each supply fan not having an associated cooling unit or filter structure and capable of providing an air velocity of greater than 1600 feet per minute;

a clean room plenum downstream of the at least one supply fan and in communication with the outlet of the at least one fan box, the clean room plenum having an outlet area defined by a filter structure downstream from the clean room plenum, each fan box being disposed outside of the clean room plenum and the clean room, the filter structure having a downstream side in communication with the clean room to deliver air thereto;

the clean room having a return flow plenum, a second ductwork extending from the return flow plenum to the at least one supply fan for recirculation of air back to the clean room through the at least one-supply fan; and a modulator for controlling the air handling system.

2. The air handling system as recited in claim 1, comprising a plurality of air handlers.

3. The air handling system as recited in claim 1, comprising two supply fans provided for operation with each air handler.

4. The air handling system as recited in claim 1, wherein the at least one air handler is adapted to provide a controlled output.

5. The air handling system as recited in claim 4, wherein the controlled output is controlled according to at least one of the group consisting of temperature, air flow rate, and humidity.

6. The air handling system as recited in claim 5, wherein the controlled output is controlled by a central processing unit.

7. The air handling system as recited in claim 1, wherein the modulator comprises at least one variable frequency drive adapted to control the at least one supply fan.

8. The air handling system as recited in claim 1 comprising said supply fans being independently controllable for supply and purge functions.

9. A method of operating a clean room, comprising:

providing a conditioned airflow from an air handler;

a cooling unit adjacent and in fluid communication with the at least one air handler;

directing the conditioned airflow through a ductwork and toward a filter structure utilizing at least one supply fan not having an associated cooling unit or filter structure, the conditioned airflow passing through a clean room plenum having an outlet area defined by the filter structure downstream from the clean room plenum, each supply fan disposed within a fan box located outside of the clean room plenum and the clean room;

directing a return airflow from the clean room through another ductwork and toward the filter structure utilizing the at least one supply fan and by-passing the air handler; and controlling the conditioned airflow through a modulator;

the flow of air through the at least one supply fan having an air velocity greater than 1600 feet per minute.

10. The method as recited in claim 9, further comprising conditioning the airflow only at the at least one air handler.

11. The method as recited in claim 10, further comprising modulating the at least one supply fan.

12. A clean room system comprising:

a ceiling portion, a floor portion, and wall portions defining a controlled environment; and an air handling system comprising:

at least one air handler having a fan adapted to provide an airflow through an outlet of the at least one air handler;

a cooling unit adjacent and in fluid communication with the at least one air handler;

at least one supply fan downstream of the at least one air handler, each supply fan disposed within a fan box and having an inlet and an outlet, the inlet of each fan box communicating with the outlet of the at least one air handler through a first ductwork, each supply fan not having an associated cooling unit or filter structure and capable of providing an air velocity of greater than 1600 feet per minute;

a clean room plenum downstream of the at least one supply fan and in communication with the outlet of the at least one fan box, the clean room plenum having an outlet area defined by a filter structure downstream from the clean room plenum, each fan box being disposed outside of the clean room plenum and the clean room, the filter structure having a downstream side in communication with the clean room to deliver air thereto;

the clean room having a return flow plenum, a second ductwork extending from the return flow plenum to the at least one supply fan for recirculation of air back to the clean room through the at least one supply fan; and a modulator for controlling the air handling system.

13. The clean room as recited in claim 12, comprising a plurality of air handlers.

14. The clean room as recited in claim 12, comprising a supply fan for operation with each air handler.

15. The clean room as recited in claim 12, wherein the air handler is adapted to provide a controlled output.

16. The air handling system as recited in claim 1, wherein the modulator comprises a controlling damper.

17. The method as recited in claim 10, wherein the airflow is conditioned according to at least one of the group consisting of temperature, air flow rate, and humidity.

18. The method as recited in claim 11, wherein the at least one supply fan is modulated using at least one of a controlling damper and a variable frequency drive.

* * * * *